US006324717B1

(12) United States Patent
Sekar

(10) Patent No.: US 6,324,717 B1
(45) Date of Patent: Dec. 4, 2001

(54) PAINT ROLLER WITH FINISHED EDGE AND METHOD FOR MAKING SAME

(76) Inventor: Chandra Sekar, 4 Sunset Rd. North, Searington, NY (US) 11507

( * ) Notice: Subject to any disclaimer, the term of this patent is extended or adjusted under 35 U.S.C. 154(b) by 0 days.

(21) Appl. No.: 09/450,406

(22) Filed: Nov. 29, 1999

(51) Int. Cl.[7] ..... B05C 17/02

(52) U.S. Cl. ..... 15/230.11; 29/895; 492/13; 492/19; 492/29

(58) Field of Search ..... 15/230, 230.11, 15/230.12, 230.13, 230.19; 29/895, 895.2, 895.21, 895.211; 492/13, 19, 29, 47, 48

(56) References Cited

U.S. PATENT DOCUMENTS

| | | | |
|---|---|---|---|
| 2,255,887 | 9/1941 | Katz | 493/346 |
| 2,331,969 | 10/1943 | Friedrichs et al. | 493/299 |
| 2,422,842 | 6/1947 | Molyneux et al. | 335/71 |
| 2,748,805 | 6/1956 | Winstead | 138/144 |
| 3,018,212 | 1/1962 | Chinn | 156/195 |
| 3,226,799 | 1/1966 | Grodberg et al. | 492/29 |
| 3,274,905 | 9/1966 | Demsey, Jr. et al. | 493/274 |
| 3,411,931 | 11/1968 | Burns et al. | 427/262 |
| 3,457,130 | 7/1969 | Morrison | 156/190 |
| 3,460,445 | 8/1969 | Ried | 493/30 |
| 3,687,778 | 8/1972 | Cichoski et al. | 156/392 |
| 3,700,520 | 10/1972 | Hielema | 156/162 |
| 3,960,624 | 6/1976 | Erlandson | 156/69 |
| 4,165,956 | 8/1979 | Hendy | 425/71 |
| 4,191,792 | 3/1980 | Janseen | 427/260 |
| 4,689,003 | 8/1987 | Schreiner et al. | 425/224 |
| 4,692,975 | 9/1987 | Garcia | 492/29 |
| 5,146,646 | 9/1992 | Langford et al. | 15/210.1 |
| 5,195,242 | 3/1993 | Sekar | 29/895.21 |
| 5,206,968 | 5/1993 | Bower et al. | 15/230.11 |
| 5,339,484 * | 8/1994 | Polzin et al. | 15/230.11 |
| 5,398,409 | 3/1995 | Sekar | 29/895.21 |
| 5,572,790 | 11/1996 | Sekar | 29/895.21 |
| 5,862,591 | 1/1999 | Kulkaski | 29/895.211 |

FOREIGN PATENT DOCUMENTS

| | | |
|---|---|---|
| 1928269 | 6/1969 | (DE) . |
| 0069335 | 6/1982 | (EP) . |
| 0 744 275 | 11/1996 | (EP) . |
| 2020431 | 1/1989 | (ES) . |
| 55-19511 | 2/1980 | (JP) . |
| 63-027234 | 2/1988 | (JP) . |
| 63-027238 | 6/1988 | (JP) . |

* cited by examiner

*Primary Examiner*—Mark Spisich
(74) *Attorney, Agent, or Firm*—Adam B. Landa; Greenberg Traurig, LLP

(57) ABSTRACT

The present invention relates to a paint roller having an open end which can be inserted into an applicator handle and a surface area adapted for use in painting. The core of the roller is made from a core material and the core has an inner surface and an outer surface. A major portion of the core has a substantially uniform thickness. A cover is affixed to substantially all of an outer surface of the core and a processed region at one end of the core has a reduced thickness which is less than the substantially uniform thickness of the major portion of the core. The processed region of the core is folded inward such that the one of the core and the reduced portion of the core material are not exposed at the end of the paint roller.

8 Claims, 4 Drawing Sheets

PAINT ROLLER WITH FINISHED EDGE AND METHOD FOR MAKING SAME

FIELD OF THE INVENTION

This invention pertains to a paint roller with a finished edge of the type used for applying paint to walls and the like.

BACKGROUND OF THE INVENTION

Paint rollers are widely used by professionals and amateurs for applying paint to walls, ceilings, and other surfaces. Typically the roller is used with an applicator having a handle secured in a rotatable fashion thereto. The roller itself generally comprises a paint absorbing and spreading cover affixed to a generally cylindrical core. As is well known in the art, the cores may be made from cardboard, chipboard, phenolic, plastic, thermoplastics such as polypropylene, vinyl or other materials. Similarly, as is well known in the art, the covers may be made from materials such as wool, or woven polyamide or polyester fibers, or other cover materials.

Until recently, almost all paint rollers were made with an internal diameter of about 1.5 inches. The use of a standard 1.5 inch internal diameter of the core permitted the rollers of various manufacturers to be interchangeable on the applicator handles. The portion of the applicator handle to which the roller was affixed is usually known as cage frame.

Recently, the mini-roller has come into common use. The mini-roller has a core with an internal diameter of approximately 0.5 inches. The mini-roller is lighter and more manageable, especially when laden with paint, than the bigger, bulkier 1.5 inch core rollers.

Instead of using a cage frame, the mini-roller is rotatably attached to the applicator handle directly to the main wire of the handle. Most often a plastic fitting insert in the core of the mini-roller is rotatably affixed directly to the wire of the applicator handle, and a slight deformation in the wire handle maintains the lateral positioning of the mini-roller.

Most manufacturers of the mini-rollers have provided a finished end and an end into which the handles are inserted. As will be discussed in more detail below, the finished ends of the mini-rollers are formed with the cover material, by sewing closed one end of a tube of cover material and sliding it about a core. The process of sewing the cover and applying a cover is labor intensive and costly.

The present invention overcomes the costly and labor intensive processes for manufacturing mini-rollers, or for that matter, any paint roller, with a finished end.

SUMMARY OF THE INVENTION

It is an object of the present invention to provide a novel paint roller with a finished end, and a process and apparatus for manufacturing the novel paint roller.

It is another object of the present invention to provide an on-the-fly method for forming a paint roller having a finished end.

It is a further object of the present invention to provide a process for manufacturing a paint roller without a longitudinal seam therein.

DETAILED DESCRIPTION OF THE INVENTION AND THE PREFERRED EMBODIMENT

Figure 1:
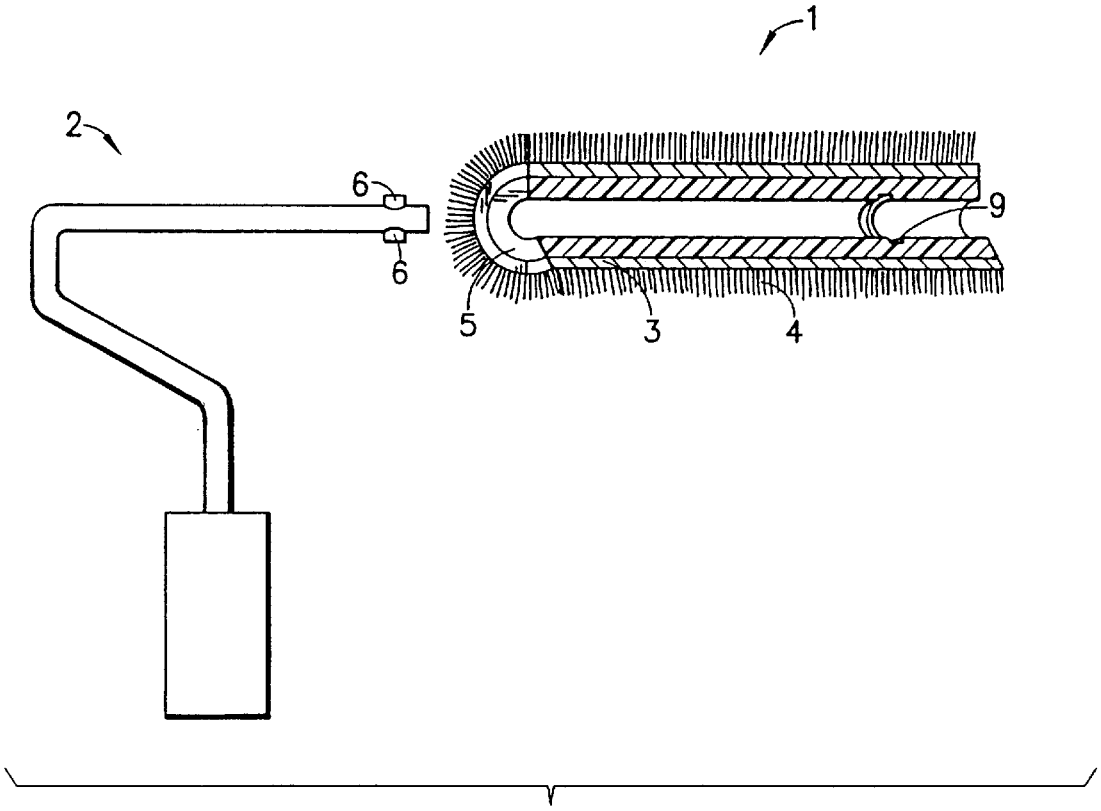
FIG. 1 PRIOR ART
FIG. 1 (prior art) shows a paint applicator handle and a cutaway view of a mini-roller that uses a plastic insert.

Turning first to the prior art, with reference to FIG. 1, a mini-roller 1 and a applicator handle 2 are shown. The mini-roller comprises a core 3 that may be made of cardboard, chipboard, phenolic, plastic, thermoplastics such as polypropylene, vinyl or other materials as are well known in the art. A cover 4 is affixed to the core 3, as will be discussed in more detail below, using an adhesive, as is well known in the art. The cover 4 surrounds one end of the core 3. An insert 5 is affixed to the inside of the core 3 so as to remain stationary with respect thereto. The insert 5 comprises a detent 9 for rotatably securing the roller 1 to the applicator handle 2.

The applicator handle 2 having one or more nubs 6 adapted to engage the detent 9 on the portion of the handle 2 that is inserted into the space formed by the insert 5. The distal end of the applicator handle 2 is inserted into the space formed by the insert 5 until the nubs 6 engage the detent 9 thereby rotatably securing the roller 1 to the applicator handle 2 for use.

Figure 2:
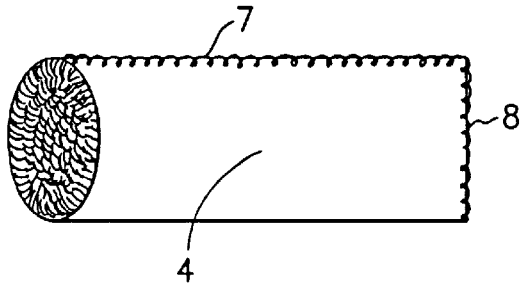
FIG. 2 PRIOR ART
FIG. 2 (prior art) shows the cover material as it is sewn in accordance with the prior art.

With reference now to FIGS. 1 and 2, it is desirable to manufacture a paint roller 1, especially a mini-roller, with a cover 4 surrounding one end of the core 3. Such a paint roller 1 may be used when painting in corners to apply paint to the adjacent wall as the roller 1 is operated.

To manufacture a paint roller 1 with the cover 4 surrounding one end of the core 3, the cover 4 is first cut, and then sewn, inside-out, along its length 7, and along one end 8. The resulting cover 4, is inverted and slid over a core 3 having a layer of adhesive first placed thereupon.

Figure 3:
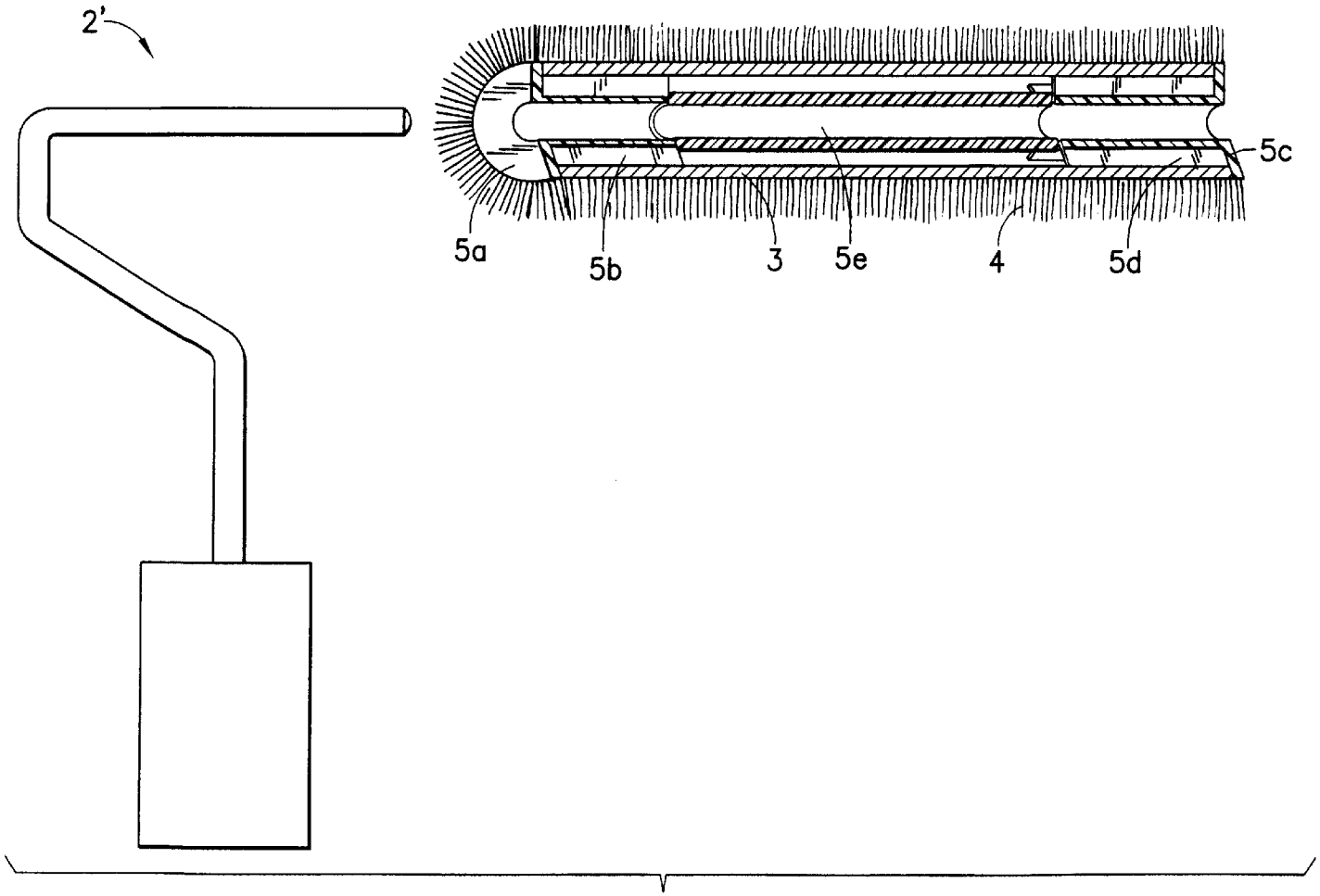
FIG.3 PRIOR ART
FIG. 3 (prior art) shows an alternative paint applicator handle and a cutaway view of a mini-roller that uses an alternative plastic insert.

FIG. 3 shows an alternative applicator handle 2' that uses friction, instead of nubs 6 and detents 9, to rotatably attach the handle 2' to the alternative roller 1'. In addition, roller 1' has no end that may be used for painting, but is disclosed to show a common alternative method of rotatably attaching the handle 2' to the roller 1'.

The opening formed by open insert part 5*a* is larger than the diameter of the insertable portion of the handle 2'. Open insert part 5*a* is attached to an inner surface of the core 3 with a friction fit. For ease of assembly, fins 5*b* are molded as part of open insert part 5*a*. In manufacturing, open insert part 5*a* is force-fit within the core 3, under normal use, it will remains stationary with respect to the core 3. Like the open insert part 5*a*, the closed insert part 5*c* has fins 5*d* for force-fitting the insert part 5*c* into the core 3. Note that the closed insert part 5*c* need not protrude from the end of the paint roller 1' as shown in the figure. Instead, closed insert part 5*c* may be placed completely within the paint roller 1'.

A flexible tube 5*e* is located within the manufactured paint-roller between the open insert part 5*a* and the closed insert part 5*c*. The flexible tube 5*e* preferably has a slit running lengthwise over the entire length of the tube, and an inner diameter slightly less than the insertable portion of the handle 2'. The length of the flexible tube 5*e* is less than the distance between open insert part 5*a* and closed insert part 5*c*, and the outer diameter of the flexible tube 5*e* is smaller than the inner diameter of the core 3 to permit the flexible tube 5*e* to rotate freely.

To attach the applicator handle 2' to the paint roller 1', the distal end of the applicator handle 2' is passed through the opening in the open insert part 5*a* and then pushed into the flexible tube 5*e*. The flexible tube 5*e* is held in place by closed insert part 5*c*. In a preferred embodiment, the flexible tube 5*e* is sufficiently flexible to require little force to insert the paint applicator handle 2' therein. Once inserted the handle 2' is rotatably fastened to the paint roller 1'. The handle 2' may be removed by applying force in the opposite direction. Open insert part 5*a* holds the flexible tube 5*e* in place during removal of the handle 2'.

Figure 4:
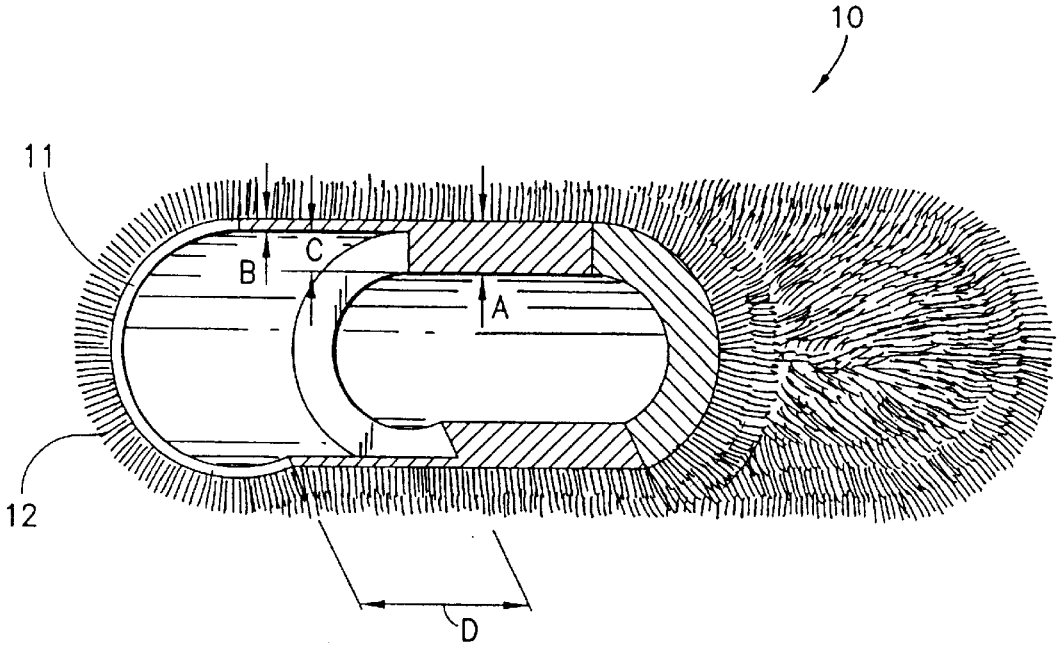
FIG. 4 is a cutaway view of a partially manufactured novel paint roller made in accordance with the present invention.

Turing now to FIG. 4, a cut-away view is shown of a paint roller 10 in the process of being manufacture according to an embodiment of the present invention. As is well known in the art, an endless paint roller may be manufactured in a continuous process and cut into lengths for finishing into paint rollers 10. The endless paint roller comprises both the core 11 and the cover 12. Thus, when an endless paint roller is cut into lengths for finishing into paint rollers 10, the cover 12 is already affixed to the core 11. Accordingly, the prior art process for manufacturing paint rollers with an end of the core covered by cover material cannot be used in connection with continuously manufactured paint rollers.

In accordance with the present invention, a paint roller 10 is processed to remove a portion of the core 11. The core 11 originally having thickness "A" throughout is processed over a length "D" to remove a substantial portion "C" of the core 11, leaving only portion "B" remaining over length "D". In a preferred embodiment, the thickness of portion "B" is made thin enough to impart substantial flexibility, but remains thick enough to retain enough strength to prevent breaking, tearing or cracking under manufacturing and use.

Figure 5:
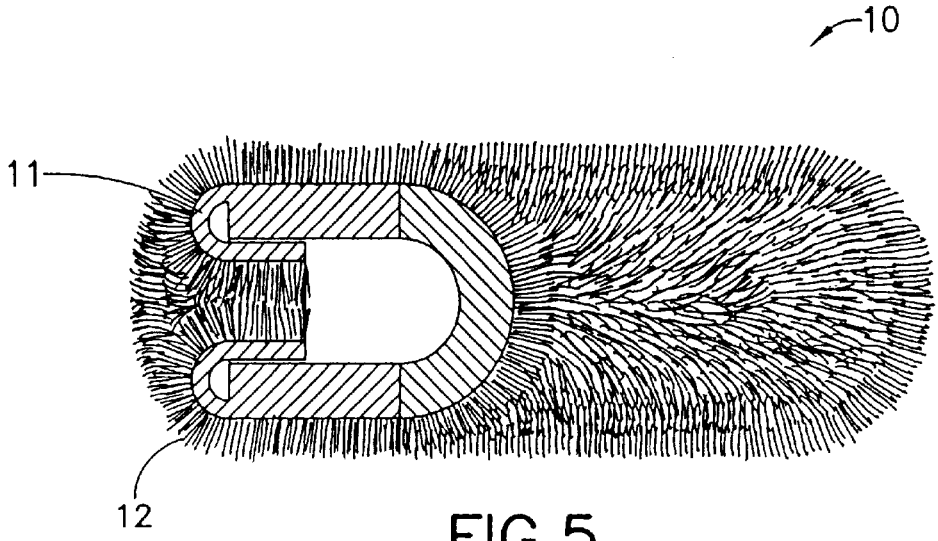
FIG. 5 is a cutaway view of the novel paint roller made in accordance with the present invention.

Turning now to FIG. 5, once the core 11 is process over the length "D", the processed region of the core 11 is then folded inward and preferably tucked toward and at least partially within the unprocessed region of the core 11, that is, the portion of the core 11 having thickness "A".

Figure 4A:
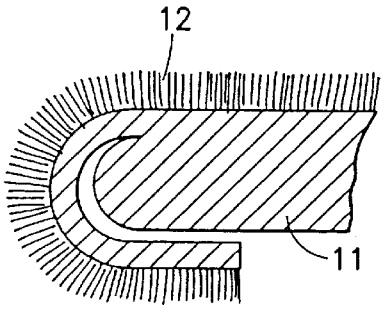
FIG. 4A shows a convex curved transition from the processed regions of the core 11 to the unprocessed region of the core 11 according to one embodiment of the present invention.

While the transition from the processed region of the core 11 to the unprocessed region of the core 11 is shown in FIG. 4 as a sharp vertical cut, as shown in FIG. 4*a*, a convex curved transition, may be desirable depending on the composition of the core 11 and the cover 12. Furthermore, a concave transition, a more gradual sloping transition, or even a steeper, angled-out transition may be desirable.

Figure 4B:
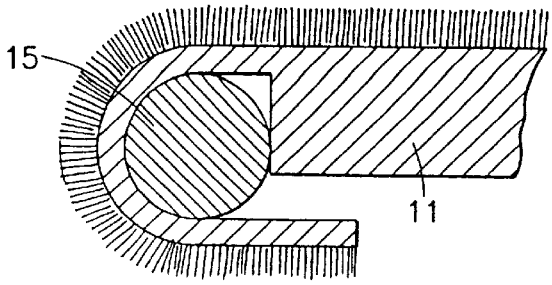
FIG. 4B shows the use of a ring adjacent to the transition between the processed regions of the core 11 to the unprocessed region of the core 11 according to one embodiment of the present invention.

FIG. 4*b* shows an alternative embodiment wherein a ring 15 is inserted adjacent to the transition between the processed and the unprocessed areas of the core 11 prior to the folding of the processed region. The ring 15 may ease the stress on the processed area of the core when the roller 10 is in use.

Figure 6:
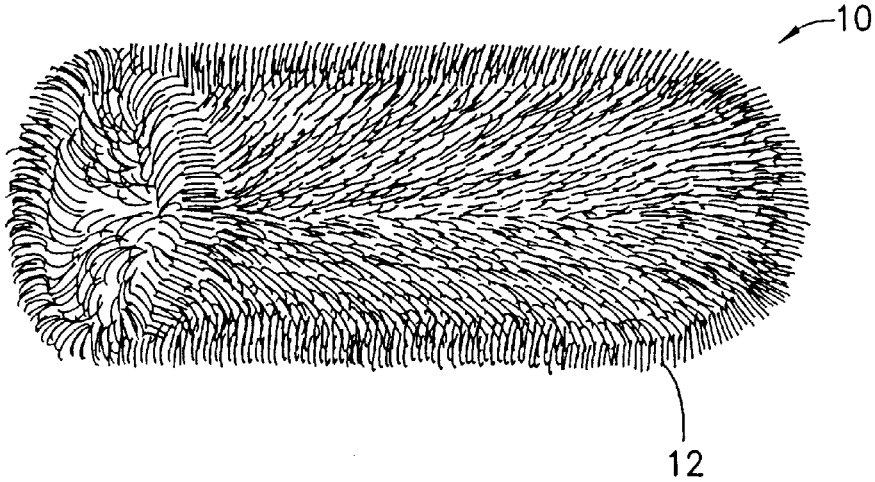
FIG. 6 is a depicts the novel paint roller made in accordance with the present invention.

FIG. 6 shows a completed roller 10 manufactured in accordance with the present invention. An insert 5 (as shown in FIG. 1) may be inserted into the open end of the roller 10 as is well known in the art. The roller 10 may then be used in connection with an applicator handle (as shown in FIG. 1) as is well known in the art.

Figure 7:
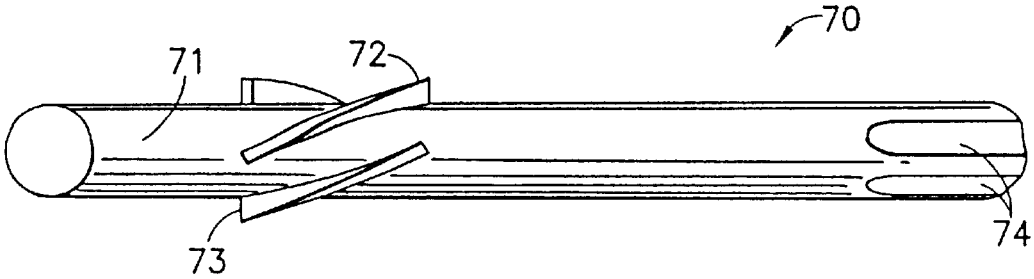
FIG. 7 shows an apparatus suitable for use in the manufacture of the novel paint roller in accordance with the present invention.

FIG. 7 shows a tool 70 designed for the manufacture of the novel paint roller. The novel tool comprises a mandrel 71 having flat edges 74 on one end for use in fastening the mandrel 71 to, for example, a drill. Affixed to the mandrel 71 are one or more fins 72 each having a cutting edge 73. The diameter of the mandrel 71 is just slightly smaller than the diameter formed by the inner surface of the core 3 of the paint roller 10 to be processed. The height of the fins 72 and the cutting edge 73 is less than the thickness of the core 11.

The tool 70 is used by affixing the end having flat edges 74 into a device (not shown) adapted to rotating the tool 70, and rotating the tool 70. Subsequently inserting the distal end of the mandrel 71 of the tool 70 into an open end of a paint roller 10. With the mandrel 71 inserted within the paint roller 10, the cutting edge 73 is brought to bear on the core 11 until the desired amount of core 11 is processed. As above, once the core 11 is processed, over the length, the processed region of the core 11 is then folded inward and preferably tucked toward and at least partially within the unprocessed region of the core 11.

While the foregoing describes and illustrates the preferred embodiment of the present invention and suggests certain modifications thereto, those of ordinary skill in the art will recognize that still further changes and modifications may be made therein without departing from the spirit and scope of the invention. Accordingly, the above description should be construed as illustrative and not in a limiting sense, the scope of the invention being defined by the following claims.

What is claimed is:

1. A paint roller having an open end adapted for inserting an applicator handle and a surface area adapted for use in painting, comprising:

a core, made from a core material, the core having an inner surface and an outer surface, a major portion of the core having a substantially uniform thickness;

a cover affixed to substantially all of the outer surface of the core;

a processed region at one end of the core having a reduced thickness which is less than the substantially uniform thickness of the major portion of the core;

the processed region of the core being folded over and inside the core such that the one end of the core and the reduced portion of the core material is not exposed at the end of the paint roller.

2. The paint roller claimed in claim 1 wherein the core material is thermoplastic.

3. The paint roller claimed in claim 1 wherein the core material is polypropylene.

4. The paint roller claimed in claim 1 wherein the core material is phenolic.

5. The paint roller claimed in claim 1 wherein the core has a substantially uniform inner diameter of approximately ½ inch.

6. A method of making a paint roller having at least one end for use in painting, comprising the steps of:

forming a paint roller, the paint roller having a core and a cover on an outer surface of the core, the core having a substantially uniform thickness and a substantially uniform inner diameter throughout the length of the paint roller;

processing a region at one end of the core by removing material to increase the inner diameter of the core in the processed region;

folding at least a portion of the processed region over and inside the core of the paint roller, thereby causing the cover to be exposed over an edge of the paint roller, wherein the edge of the paint roller is adapted for use in painting.

7. The method claimed in claim 6, wherein the substantially uniform inner diameter is between about 1½ inches and ½ inch.

8. The method claimed in claim 7, wherein the substantially uniform inner diameter is approximately ½ inch.

* * * * *